US005474233A

United States Patent [19]

Cailliau

[11] Patent Number: 5,474,233

[45] Date of Patent: Dec. 12, 1995

[54] INSERT WITH RETAINING BOSS FOR FIXATION OF A RAIL CLIP

[75] Inventor: Joël Cailliau, Faches Thumesnil, France

[73] Assignee: Allevard, France

[21] Appl. No.: 189,670

[22] Filed: Feb. 1, 1994

[30] Foreign Application Priority Data

Feb. 5, 1993 [FR] France ..... 93 01318

[51] Int. Cl.[6] ..... E01B 9/30

[52] U.S. Cl. ..... 238/351; 238/338

[58] Field of Search ..... 238/338, 349, 238/351

[56] References Cited

U.S. PATENT DOCUMENTS

| | | | |
|---|---|---|---|
| 2,954,169 | 9/1960 | Rigby | 238/351 X |
| 4,718,604 | 1/1988 | Eisenberg et al. | 238/349 |
| 4,953,787 | 9/1990 | Fee | 238/338 X |
| 5,069,386 | 12/1991 | Duval | 238/338 X |

FOREIGN PATENT DOCUMENTS

| | | | |
|---|---|---|---|
| 236340 | 3/1964 | Australia | 238/349 |
| 0194550 | 4/1986 | European Pat. Off. . | |
| 3813434 | 4/1988 | Germany . | |
| 1044884 | 10/1966 | United Kingdom | 238/349 |
| 2095311 | 9/1982 | United Kingdom | 238/338 |

*Primary Examiner*—David M. Mitchell
*Assistant Examiner*—S. Joseph Morano
*Attorney, Agent, or Firm*—Mark T. Basseches

[57] ABSTRACT

This invention relates to an insert for fixation of a railway clip comprising an inner conduit, parallel to the rail, intended to receive the rectilinear central portion of the clip, a horizontal rear face on which abuts the rear portion, parallel to the rail, of the clip which is joined to the central portion by a 180° bend and which then extends towards the rail, above the inner conduit, by a substantially perpendicular loop whose end comes into abutment on an insulating stop resting on the base of the rail, wherein the upper face of the insert comprises, towards the inlet orifice of the inner conduit, a retaining boss against which the loop of the clip comes into bearing contact to maintain the clip in a position of equilibrium, where the free end of the central portion is placed in the inlet orifice of the inner conduit.

5 Claims, 6 Drawing Sheets

INSERT WITH RETAINING BOSS FOR FIXATION OF A RAIL CLIP

FIELD OF THE INVENTION

The present invention relates to an insert for fixation of a rail clip.

BACKGROUND OF THE INVENTION

Rail clips are generally fixed by means of inserts anchored in the sleeper in the proximity of the rail.

Inserts exist in particular, comprising an inner conduit, parallel to the rail intended to receive the rectilinear central portion of the clip, a horizontal rear face on which abuts the rear portion, parallel to the rail, of the clip which is connected to the central portion by a 180° bend and which extends towards the rail above the inner conduit, by a substantially perpendicular loop whose end comes into abutment on an insulating stop resting on the rail base.

With this type of insert, the assembly of the elastic clip is difficult.

In fact, to effect assembly, the central portion of the clip must previously be disposed approximately in the longitudinal axis of the inner conduit, allowing a clearance between the loop and the upper face of the insert so as to allow the laying tools to exert a horizontal supporting force on the loop.

This position of equilibrium of the clip can possibly be obtained only with a clip of which the central portion extends beyond the vertical plane of the loop in order to be able to be introduced in the conduit without modifying the position of the loop.

However, such clips are of more complex manufacture, heavier and more expensive.

It is an object of the present invention to solve the technical problem set forth hereinabove.

SUMMARY OF THE INVENTION

To that end, the invention relates to an insert in which the upper face comprises, towards the inlet orifice of the inner conduit, a retaining boss against which the loop of the clip comes into supporting contact to maintain the clip in a position of equilibrium where the free end of the central portion is placed in the inlet orifice of the inner conduit.

According to an advantageous feature of the invention, said retaining boss comprises a bearing face extending towards the inner conduit and presenting a profile corresponding to that of the loop.

According to another feature, the bearing face of the boss presents a concave curvature whose radius is substantially equal to the radius of the section of the wire of the loop so as to allow a pivoting of the clip in contact with said bearing face about an axis perpendicular at to the longitudinal axis of the conduit.

According to yet another feature, the height of the boss with respect to the lower inner face of the inner conduit is greater than the distance separating the lower face of the central portion and the lower face of the top of the loop.

According to an advantageous embodiment, the boss is made to be offset with respect to the vertical plane passing through the longitudinal axis of the inner conduit and its position is such that the central portion can leave the inner conduit only by pivoting the loop in contact with the bearing face.

According to another embodiment, the inlet orifice of the inner conduit is bevelled at least on its upper edge in order to facilitate pivoting of the clip.

The boss is preferably disposed at the lateral end of the upper face, towards the inlet orifice of the inner conduit and its apex is offset towards the rear face with respect to the apex of the upper face.

According to a particular embodiment, the boss is made by shaping at least a part of the upper face with a profile corresponding to the curvature of the loop.

According to another embodiment, the boss is disposed on a head located on the upper face towards the inlet orifice of the conduit.

The insert of the invention with the retaining boss ensures a stable equilibrium of the clip in an appropriate position before it is assembled. This equilibrium is virtually insensitive to possible disturbances and/or vibrations generated by the laying machines or by accidental clumsiness of the laying staff.

Once mounted, the clip, with its central portion inserted completely in the inner conduit, can only be removed by firstly causing it to effect a translation until the loop comes into stop contact against the boss then an upward pivoting followed by an inclined rectilinear displacement with respect to the longitudinal axis of the inner conduit.

It is clear that such movement of the clip can only be intentional and cannot result from an accidental disturbance.

Moreover, the insert of the invention makes it possible to position the clip in simple and stable manner, prior to the final assembly operation whilst arranging a clearance between the loop and the upper face for the final action of the laying tools.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
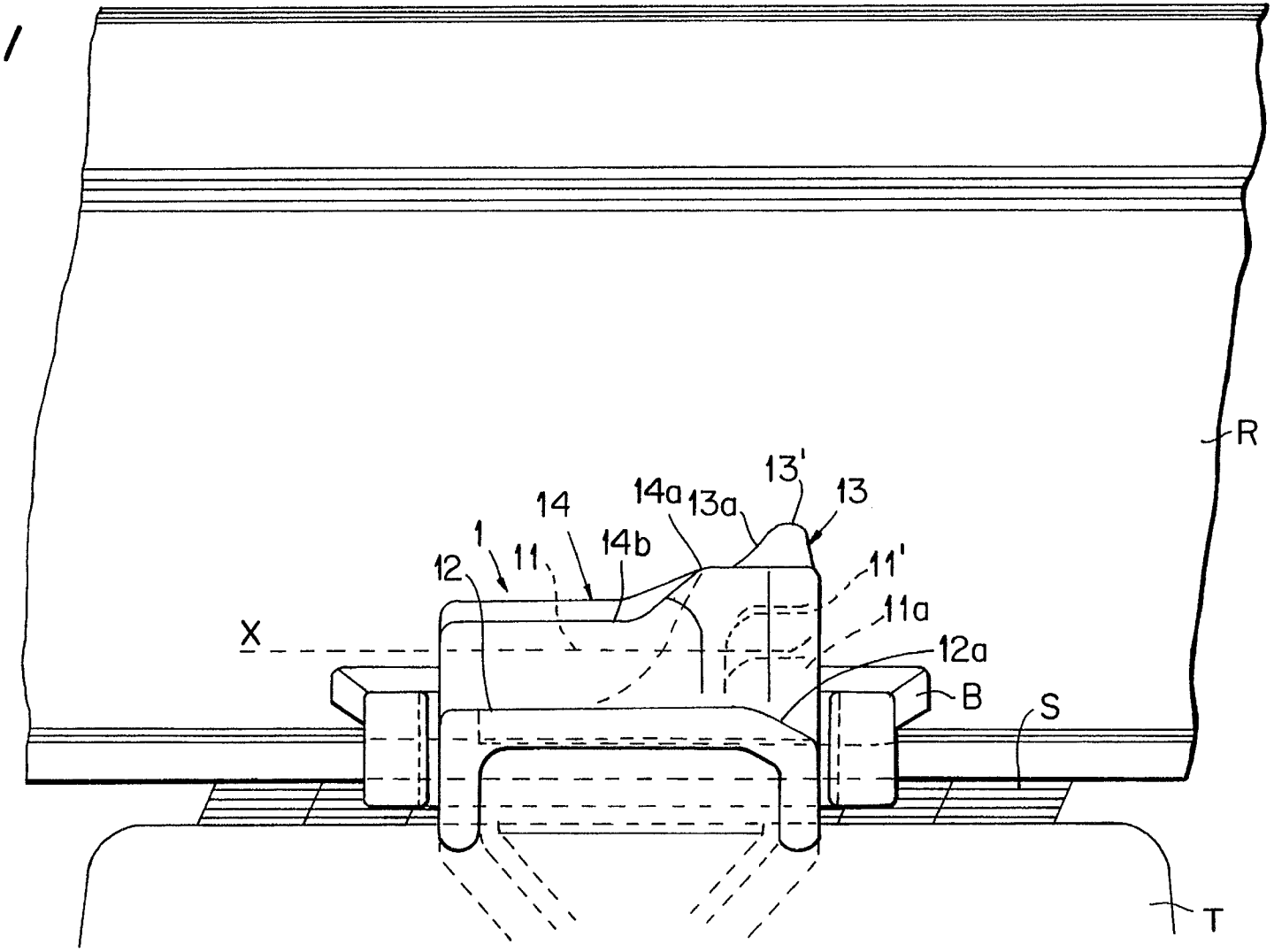
FIG. 1 is a lateral view of the insert of the invention.
Figure 6:
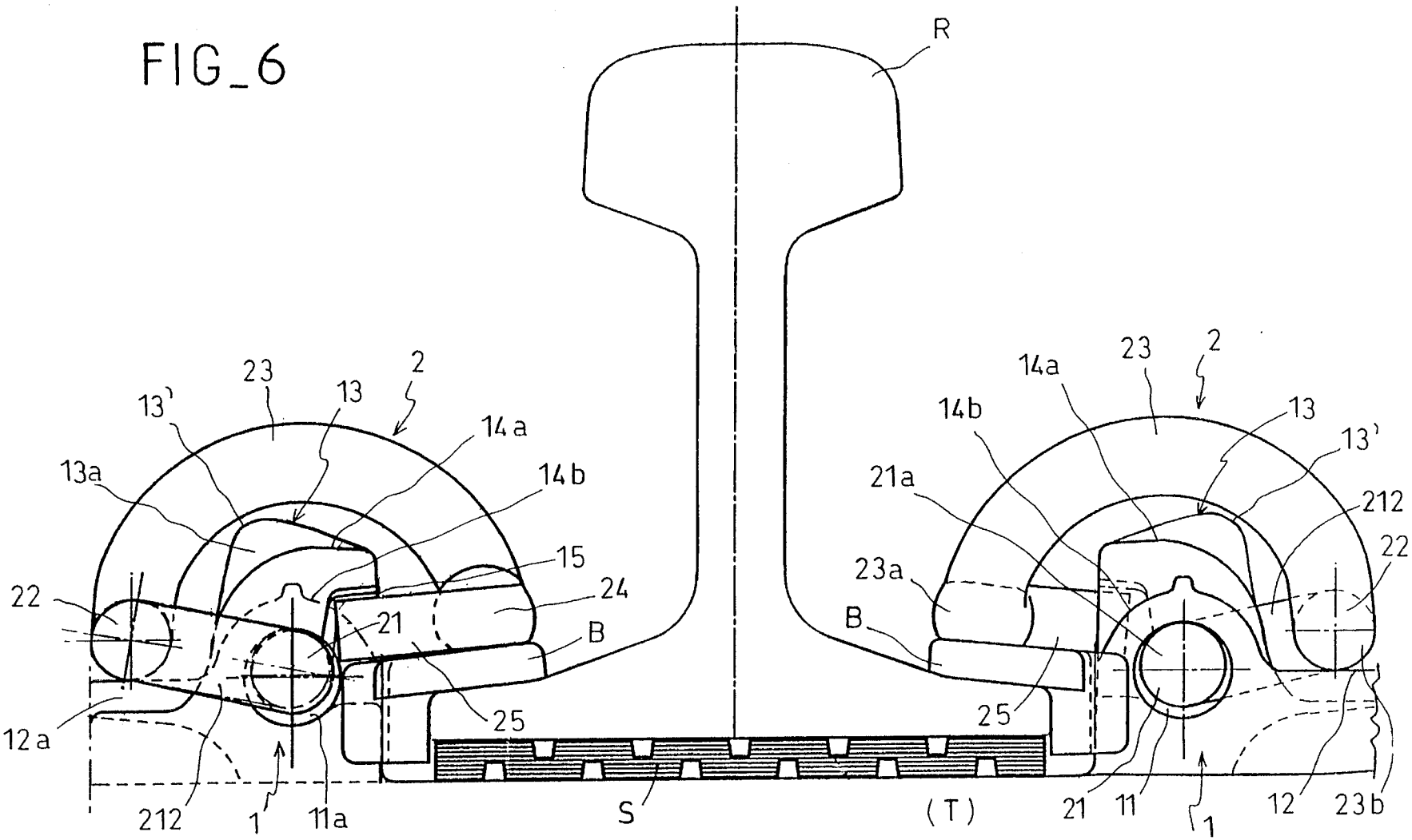
FIG. 6 is a front view of the device for fixing the rail with its two lateral inserts and its two clips.

Referring now to the drawings, the insert 1 of the invention, as shown in particular in FIGS. 1 and 6, is anchored on a sleeper or tie T and comprises an inner conduit 11 parallel to the rail R and intended to receive the rectilinear central portion 21 of the elastic clip 2 in mounted position.

Insert 1 also comprises a horizontal rear face 12 on which rests the rectilinear rear portion 22 of the clip.

Portions 21, 22 are both parallel to the rail R and are joined by a 180° bend 212.

Portion 22 of the clip extends towards the rail R, passing above the inner conduit 11 of the insert 1 by a substantially perpendicular loop 23 and whose end 23*a* comes into abutment on an insulating stop B in contact with the base of the rail R which is laid on a sole 5.

In the embodiment shown in the FIGS., the loop 23 extends in a substantially vertical plane also containing the free end 21*a* of the central portion 21.

Loop 23 is thus plumb with the end 21*a* and loop 2 is compact. Loop 23 extends towards rail R by a rectilinear front portion 24 which is in-abutment on rail R via stop B.

The upper face 14 of the insert comprises, towards the inlet orifice 11a of the conduit 11, a retaining boss 13 against which the loop 23 of the clip comes into bearing contact to facilitate introduction of the central portion 21 in the conduit 11 during assembly. The upper face 14 comprises two levels: an upper, so-called head, level 14*a* located towards the inlet orifice 11*a* of the conduit 11 and a lower level 14*b*.

The front portion 24 presents a return 25 towards the insert 1 which is blocked in the insert by a housing 15 of the head 14*a*.

The boss 13 is provided on the head 14*a* and preferably in the vicinity of the inlet orifice 11a which comprises a bevelled face 11' at least on its upper edge.

The apex 13' of the boss is offset towards the rear face 12 with respect to the apex of the head 14*a*.

Figure 2:
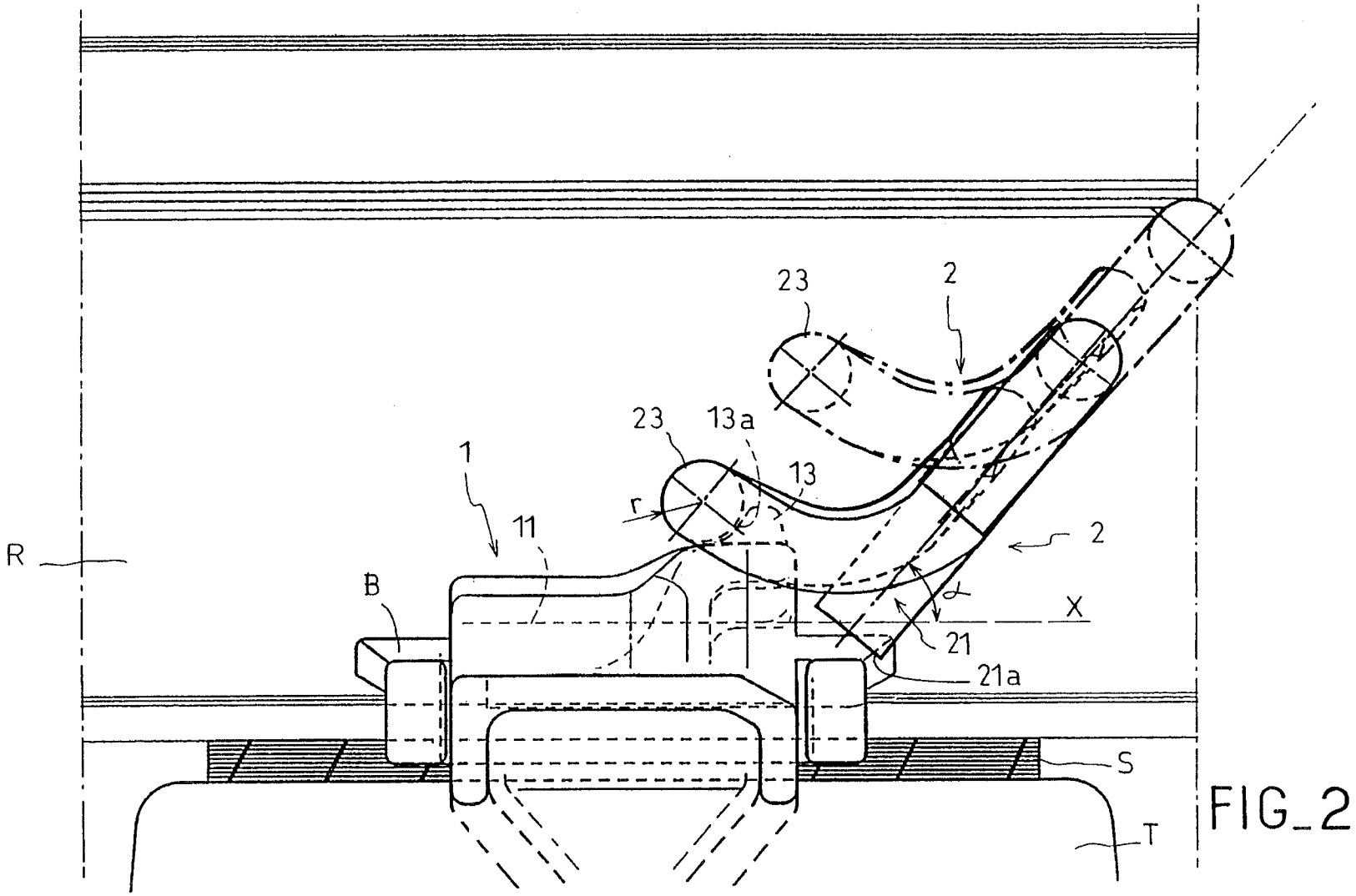
FIG. 2 is a lateral view of the insert of FIG. 1 with the clip in lead-in position.

FIG. 2 represents the insert 1 and the clip 2 in two different, successive positions of the lead-in phase.

In these positions, the central portion 21 is oriented along an axis inclined by an angle $\alpha$ with respect to the longitudinal axis x of the conduit 11.

The clip 2 is brought closer to the insert 1 until the loop 23 is hooked behind the boss 13 in contact with the bearing face 13*a* which extends towards the conduit 11 and which presents a profile corresponding to that of the loop 23.

Figure 3:
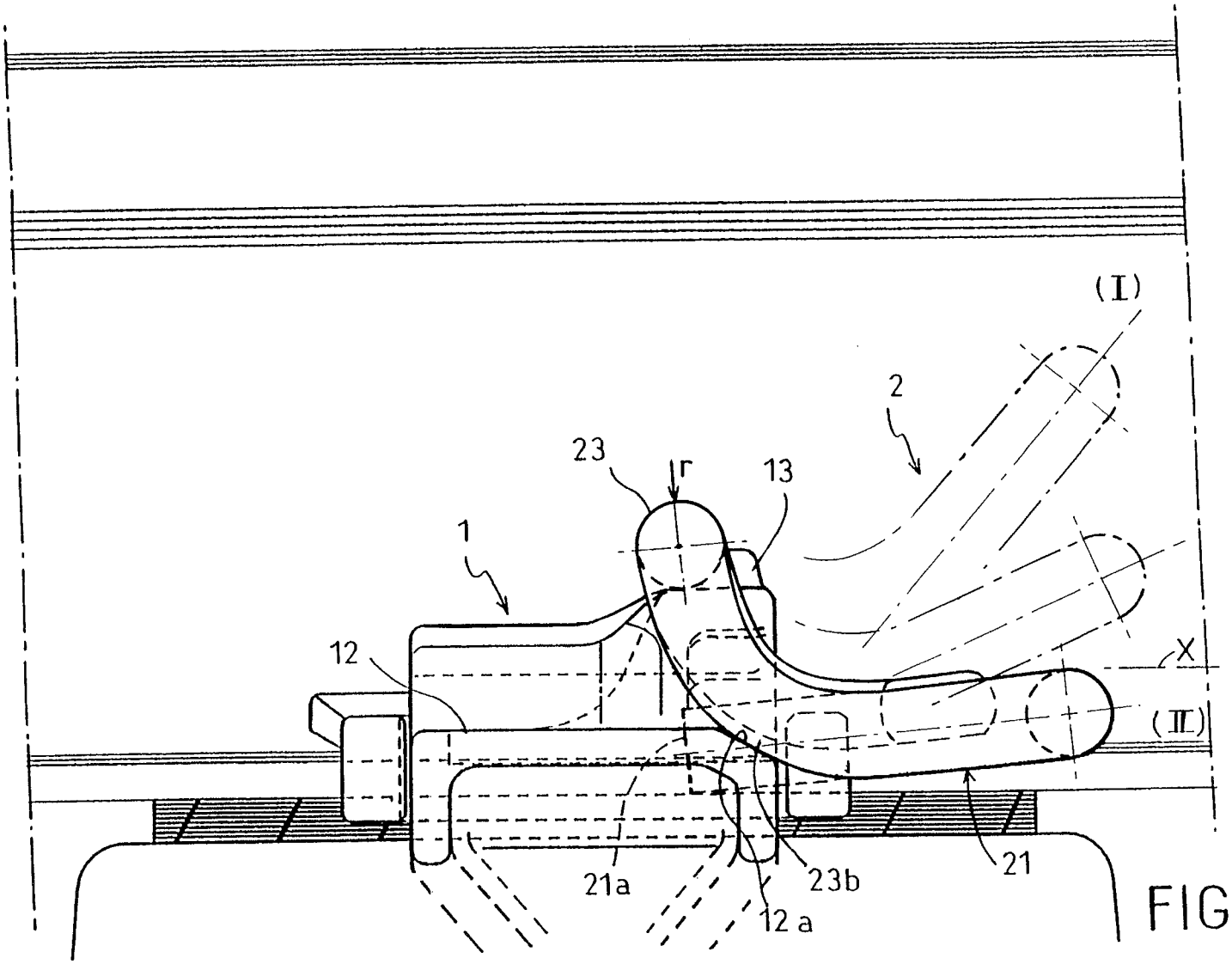
FIG. 3 is a lateral view of the insert and the clip during pivoting.

As shown in FIG. 3, the bearing face 13*a* of the boss 13 presents a concave curvature whose radius is substantially equal to the radius r of the section of the wire of the loop 23 ao as to allow a pivoting of the clip 2 in contact with said bearing face.

Pivoting of the clip 2 is effected whilst the loop 23, and therefore the clip 2, is retained vertically and horizontally by the boss 13. Pivoting causes the clip 2, solely under the action of its weight, to pass from a position (I) where the axis of the central portion 21 is inclined by an angle $\partial$ with respect to the longitudinal axis X of the conduit 11 to a position (II) where the free end 21*a* of the portion 21 is placed in the inlet orifice 11*a* of the conduit 11. In this latter position, the clip 2 is in stable equilibrium and the portion 21 is approximately coaxial with conduit 11.

This position of stable equilibrium is obtained by the vertical and horizontal retention of the loop 23 in contact with the bearing face 13*a* of the boss 13 and by the abutment of the two lower ends 23*a*, 23*b* of the loop 23 respectively on the lateral edge of the stop B and on the bevelled lateral edge 12*a* of the rear face 12. The bevelled upper edge 11' of the inlet orifice 11*a* of the conduit 11 facilitates introduction of the central portion 21 in the conduit 11 by eliminating any point of blocking.

Figure 4:
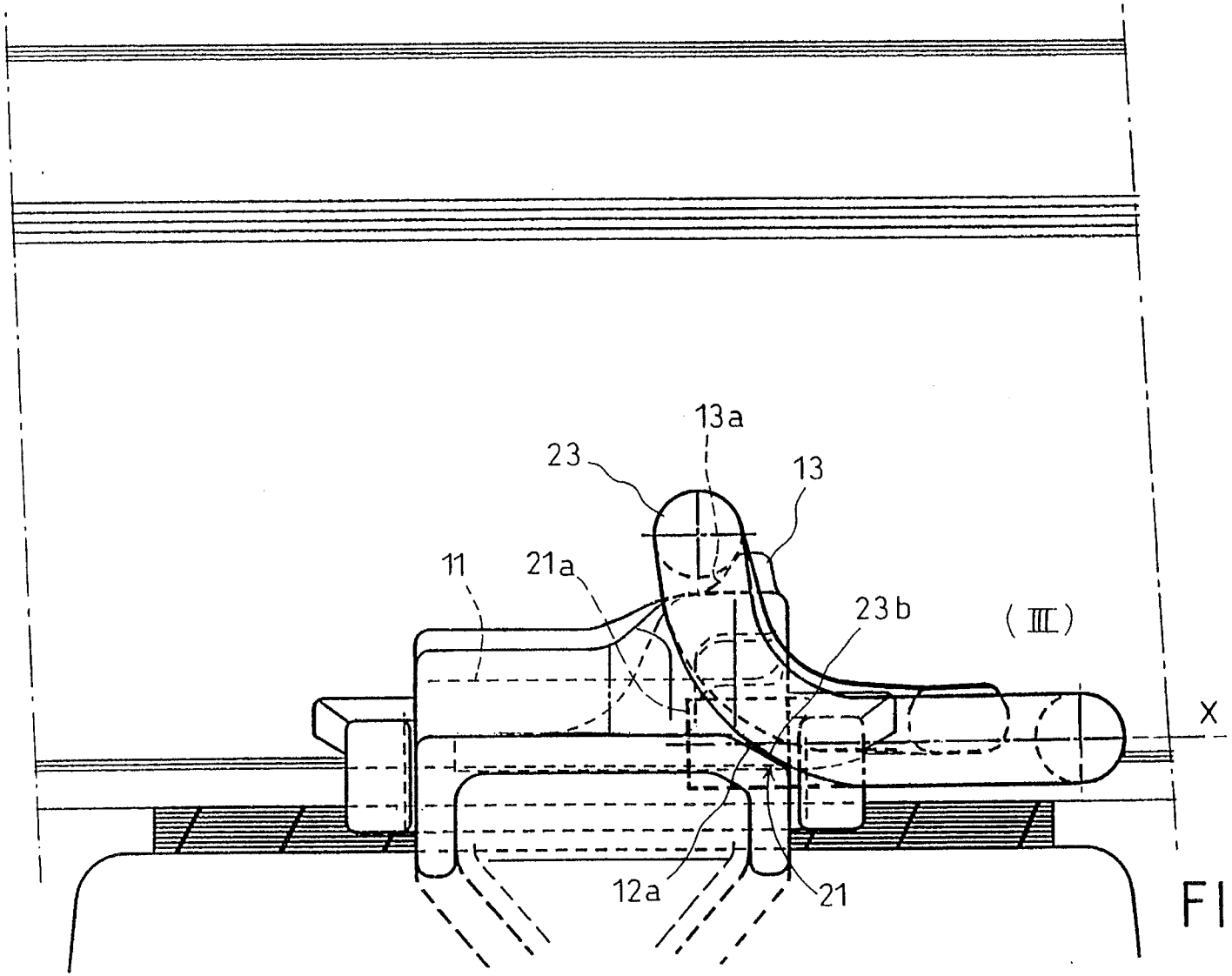
FIG. 4 is a lateral view of the insert with the clip in equilibrium.

In the position shown in FIG. 4, the clip 2 is still in equilibrium and the loop 23 is still in contact with-the bearing face 13*a* of the boss 13 but only over a part, whilst a part of the central portion 21 is already introduced in the conduit 11.

Figure 5:
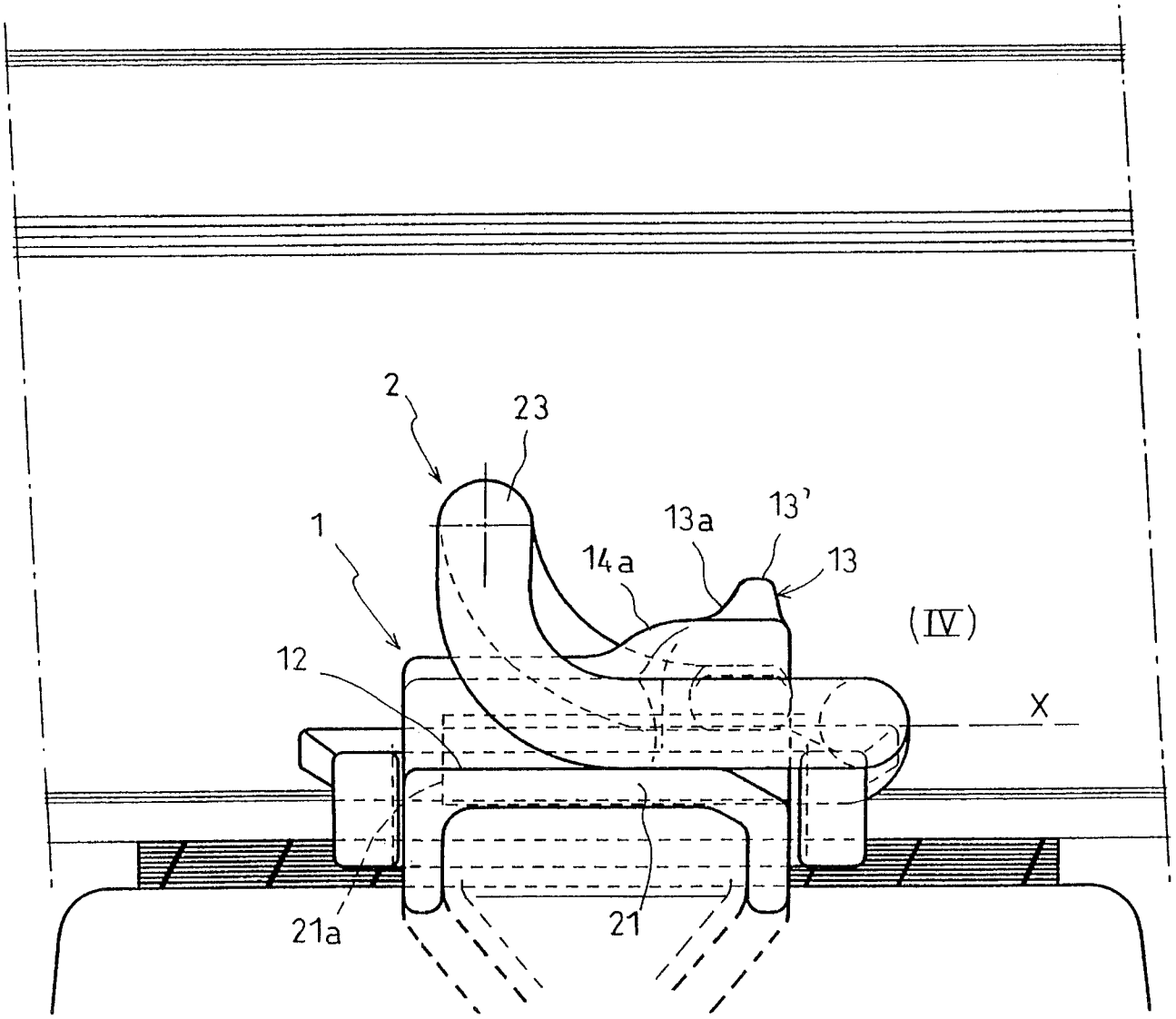
FIG. 5 is a lateral view of the insert with the clip mounted.

All that remains is to push the portion 21 completely in the conduit 11 to terminate assembly and place the clip 2 in the position (IV) shown in FIG. 5. The height of the boss 13 is such that the loop 23 and the bearing face 13*a* are always in contact in the position (III) prior to the final assembly operation so as to prevent the translation of the central portion along axis X in opposite direction, out of the conduit.

Therefore, the boss also has a function of stop. To that end, the height of the apex 13' of the boss 13 with respect to the lower inner face of the conduit 11 is therefore greater than the distance separating the lower face of the central portion 21 and the lower face of the loop 23.

The boss is preferably offset towards the rear face 12 and its position on the head 14a of the upper face 14 is such that the clip can be withdrawn only by following the path opposite the one which was described hereinabove for assembly.

The boss may be made in one piece width the head 14*a* of the insert 1 or, in another embodiment, in the form of an added piece which is welded, clipped or screwed.

What is claimed is:

1. A rail mounting assembly for fixing the rail of a railway comprising an insert and a clip, said insert including an axially extending conduit having an inlet orifice, a retaining boss on said insert, said boss having an upwardly directed arcuate surface disposed generally perpendicularly to said conduit, upwardly directed stop means adjacent said arcuate surface, a resilient clip adapted to be connected to said insert, said clip including an elongate central portion adapted to be received in said conduit, said central portion having a free end, a loop portion on said clip, the axis of said loop portion being perpendicular to the axis of said central portion, the exterior of said loop portion having a radius of curvature complemental to said arcuate surface, said clip being dimensioned such that when said loop portion of said clip engages said stop means, axial relative movement of said central portion away from said insert portion is prevented and said free end of said central portion is gravationally maintained in registry with said inlet orifice.

2. A mounting assembly in accordance with claim 1 wherein said insert includes a beveled portion upwardly adjacent said inlet orifice, said beveled portion being inclined toward the axis of said conduit.

3. A rail mounting assembly for fixing the rail of a railway comprising an insert and a clip, said insert including an axially extending conduit having an inlet orifice, a retaining boss on said insert, said boss having an upwardly directed arcuate surface disposed generally perpendicularly to said conduit, a resilient clip adapted to be connected to said insert, said clip including a elongate central portion adapted to be received in said conduit, said central portion having a free end, a loop portion on said clip, the axis of said loop portion being perpendicular to the axis of said central portion, the exterior of said loop portion having a radius of curvature complemental to said arcuate surface, said clip being dimensioned such that said central portion of said clip is gravationally maintained in coaxial alignment with said conduit with said free end of said central portion in proximate relation to said inlet orifice when said loop is disposed on said arcuate surface of said boss, said boss being laterally displaced from a vertical plane extending through the longitudinal axis of said conduit whereby said clip may be removed from said insert solely by combined initially axial and subsequent pivotal movement of said clip relative to said insert.

4. A mounting assembly in accordance with claim 3 wherein said boss includes upwardly directed stop means adjacent said arcuate surface to thereby limit axial relative movement of said central portion away from said insert, said stop means being located such that said free end of said central portion is gravationally maintained in registry with said inlet orifice when said loop engages said stop means.

5. A mounting assembly in accordance with claim 3 wherein said insert includes a beveled portion upwardly adjacent said inlet orifice, said beveled portion being inclined toward the axis of said conduit.

* * * * *